US005177318A

United States Patent [19]

Martinez et al.

[11] Patent Number: 5,177,318

[45] Date of Patent: Jan. 5, 1993

[54] DEVICE FOR IDENTIFYING AND CHECKING THE AMMUNITION OF AN AUTOMATIC-LOADING FIREARM AND PROCESS FOR ITS IMPLEMENTATION

[75] Inventors: Yves Martinez, Puteaux; Gerard Bouvet, St. Etienne, both of France

[73] Assignee: Mecanique Creusot-Loire, Puteaux, France

[21] Appl. No.: 777,081

[22] Filed: Oct. 16, 1991

[30] Foreign Application Priority Data

Oct. 17, 1990 [FR] France ..... 90 12822

[51] Int. Cl.[5] ..... F41A 9/55

[52] U.S. Cl. ..... 89/46; 89/33.1; 89/33.04; 89/33.05; 89/47

[58] Field of Search ..... 89/33.1, 33.01, 33.02, 89/33.03, 33.04, 33.05, 45, 46, 47, 33.14

[56] References Cited

U.S. PATENT DOCUMENTS

| | | | |
|---|---|---|---|
| 2,933,981 | 4/1960 | Anderson et al. | 89/45 |
| 4,519,522 | 5/1985 | McElwee | 221/13 |
| 4,535,677 | 8/1985 | Panhke et al. | 89/46 |
| 4,640,181 | 2/1987 | Schiele et al. | 89/46 |
| 4,671,164 | 6/1987 | DeHaven et al. | 89/45 |
| 4,765,223 | 8/1988 | Beckmann | 89/33.04 |
| 4,777,864 | 10/1988 | Steeb et al. | 89/33.03 |
| 5,020,958 | 6/1991 | Tuttobene | 414/281 |

FOREIGN PATENT DOCUMENTS

| | | | |
|---|---|---|---|
| 0099963 | 2/1984 | European Pat. Off. | 89/46 |
| 0105101 | 4/1984 | European Pat. Off. . | |
| 0217059 | 4/1987 | European Pat. Off. | 89/46 |
| 3830903 | 3/1990 | Fed. Rep. of Germany . | |
| 2065844 | 7/1981 | United Kingdom | 89/45 |

*Primary Examiner*—Stephen M. Johnson
*Attorney, Agent, or Firm*—Cushman, Darby & Cushman

[57] ABSTRACT

The invention relation to a device for identifying and checking ammunition on an automatic-loading device of a firearm. The firearm is capable of firing ammunition of different types. The device includes a rotating magazine having adjacent chambers for accommodating an ammunition round. The device further includes at least one fixed code reader arranged on a path of the magazine. The code reader includes optical detectors aligned in parallel with a center line of the ammunition round. Each ammunition round has a cylindrical coding zone on a cartridge thereof. The coding zones consist of annular coding tracks. The device utilizes the coding zones to identify and check the location of ammunition to expedite loading of the firearm. A method of utilizing the device is also provided.

13 Claims, 3 Drawing Sheets

DEVICE FOR IDENTIFYING AND CHECKING THE AMMUNITION OF AN AUTOMATIC-LOADING FIREARM AND PROCESS FOR ITS IMPLEMENTATION

This invention relates to automatic-loading firearms firing different types of ammunition as required. This is the case in particular with the guns of combat tanks which have to be able to fire ammunitions appropriate to their target, for example anti-helicopter type, dart type or ammunition with a hollow charge.

Such guns are fed by a rotating magazine or conveyor consisting of adjacent chambers each made to accommodate one round of ammunition; a mechanical drive device allows this conveyor to be turned stepwise in both directions of rotation, one step corresponding to the distance between two neighboring chambers, so that each chamber can be brought into a gun-loading position.

The loading device must be able to identify the type of ammunition present in each chamber and check that the round presented at the loading position is in fact that selected by the operator in the tank.

In addition it is necessary that the automatic loading procedure should be as reliable as possible and this applies even during operation with a system indicated as having a partial malfunction.

In fact, it is of fundamental importance with combat tanks to fire as rapidly as possible, as soon as the target has been identified by the tank commander, since the combat tank can only break cover for a very short time or it runs the risk of being located and attacked by the enemy.

SUMMARY OF THE INVENTION

This invention is thus intended to supply a device for identifying and checking the ammunition so as to provide reliable identification of the round presented to the loading position, the loading operation being carried out in the shortest possible time, and this being particularly so in cases where the system is indicated as having a partial fault.

This invention therefore relates to a device for automatic identification and checking of ammunition for an automatic loading device of a firearm capable of firing ammunition of different types, such as the gun of a combat tank, comprising a rotating magazine with adjacent chambers each able to accommodate one round of ammunition, characterized by the fact that it has at least one fixed code reader arranged on the path of the said rotating magazine, comprising optical detectors aligned in parallel with the centre line of the ammunition round, and that each round of ammunition has a cylindrical coding zone on the outside surface of its cartridge, consisting of at least one circular coding track contrasting with the background of this zone, each coding track being associated with one optical detector and being arranged opposite this detector, each ammunition identification code comprising at least one coding track.

This makes it possible to effect "on the fly" reading of the code carried on each round of ammunition. This reading is very reliable since each detector detects only one coding track; this reading of the code is strictly independent of the speed of movement of the ammunition in front of the code reader because it is synchronized with the movement of the chambers.

It is an advantage for the code reader to include an additional optical detector to establish the background level, this additional optical detector being associated with a blank coding track, which, by providing a threshold measurement, permits verification of the presence of a round in the chamber.

This additional optical detector also provides a reference level corresponding for example to logic "0", the presence of a contrasting coding track corresponding to logic "1".

By means of another characteristic of the invention, at least one chamber of the magazine has at least one test label with coding tracks arranged perpendicular to the centre line of the ammunition round and positioned opposite the optical detectors of the code reader.

It is an advantage to have two code readers arranged one either side of the loading position; in addition a test label is arranged on each of the chambers.

In this way, it is possible to test one of the two code readers by a movement of the rotating magazine of less than one unit step.

The invention also relates to a process for automatic loading of ammunition for a firearm capable of firing different types of ammunition and comprising a device for identification and checking of ammunition as defined above, characterized by the fact that, when a round of ammunition is requested, the processor reads the contents of the magazine in the RAM and determines the number of steps and the direction of movement to be effected by the rotating magazine to transfer the ammunition of the requested type nearest to a code reader to the loading position, so that the said ammunition is then positioned in front of the code reader.

BRIEF DESCRIPTION OF THE DRAWINGS

The invention will be better understood with the aid of the description which follows, which is given solely by way of example and refers to the attached drawings, of which.

DESCRIPTION OF THE PREFERRED EMBODIMENT

Figure 1:
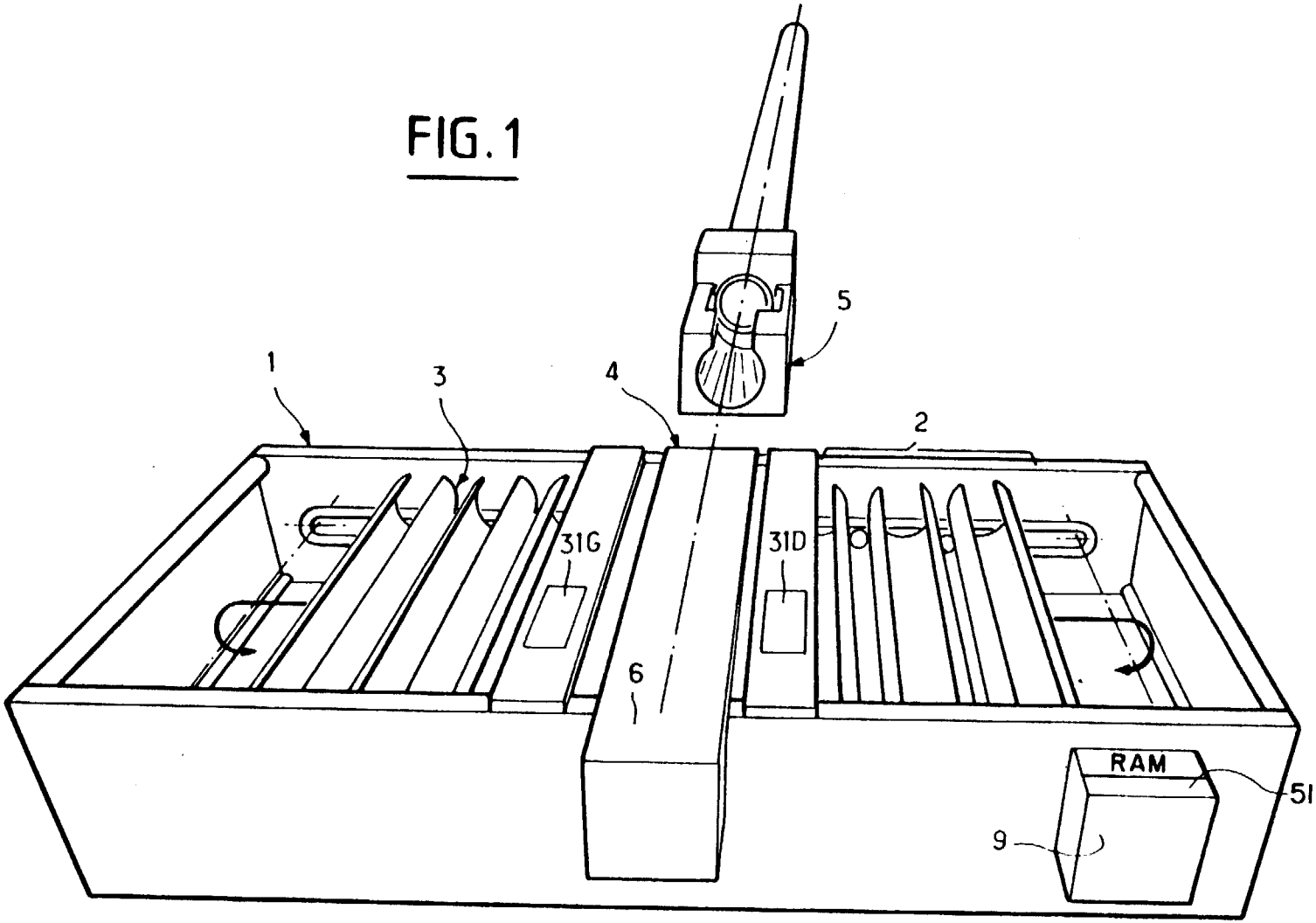
FIG. 1 is a schematic perspective view of a device for automatic loading of the gun of a combat tank.

The automatic loading device shown in FIG. 1 consists of a frame 1 with an endless conveyor 2 which consists of 22 adjacent chambers 3, each designed to accommodate one round of ammunition.

The conveyor 2 can be driven in both directions of rotation by a stepping motion which permits any chamber to be aligned with a central loading position 4 placed in the extension of the chamber or breech of the gun 5. The loading position is equipped with a ram 6 by means of which the ammunition can be pushed into the breech of the gun.

The drive motor of the magazine is controlled from a control box (not shown) also controls the other motors of the device and which receives various data, in particular data on the position of the chambers supplied by a detector (not shown).

A box 9 contains an electronic processing and computing unit.

To ensure correct loading of the gun, it is first of all necessary to identify the ammunition rounds in the rotating magazine. For this purpose at least one code reader is provided which is fixed with respect to the rotating magazine in such a way that the rounds present in the chambers are identified as they pass in front of the reader.

The rounds of ammunition are provided with a kind of bar code consisting of the circular tracks arranged on the cartridge of each round. In this way, whatever the angular position of the round in the chamber, the bar code will always be visible through the open area 10 formed in the upper part of the chamber.

Figure 3:
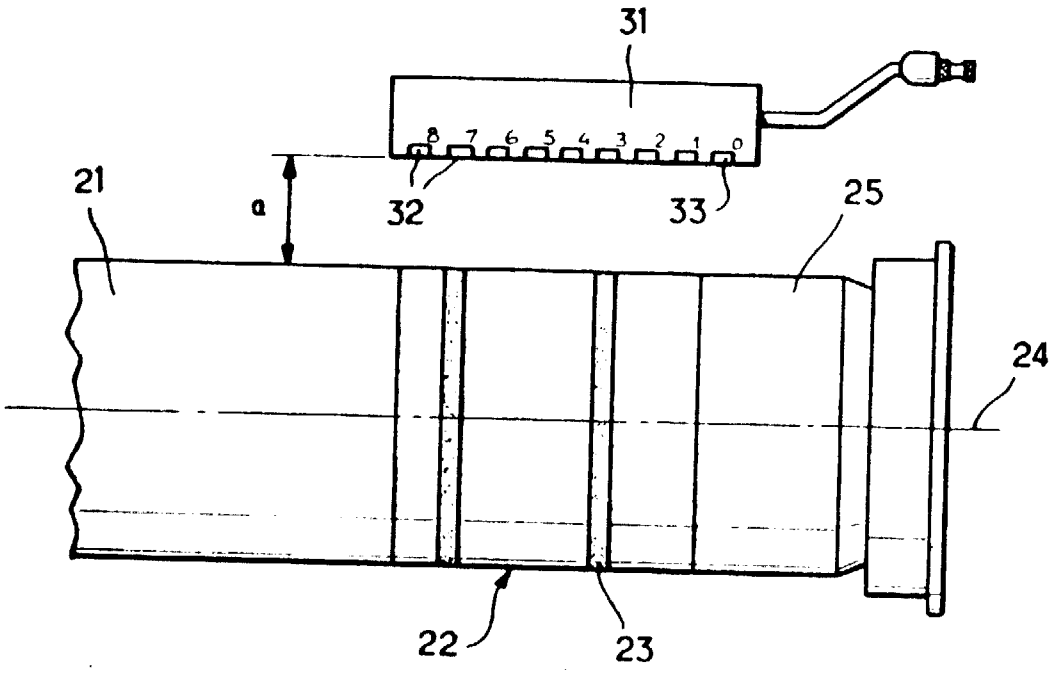

As can be seen in FIG. 3, a cylindrical coding zone 22 is arranged on the outer surface of the cartridge 21 of the ammunition round; this zone can consist, as in the example shown, of 8 coding tracks such as the bands 23, which are in positions 3 and 7 when read from the right.

We thus obtain a bar-coding facility allowing 8-bit binary coding: absence of the track represents for example a binary "0" and presence of the track a binary "1". These coding tracks are effected for example by painting and they exhibit sufficient contrast with respect to the background of the cartridge to allow them to be reliably detected.

In FIG. 3 a code reader 31 is shown which consists of optical detectors 32 which are aligned in parallel with the centre line 24 of the cartridge 21. This 31 comprises nine optical detectors, i.e. eight detectors each associated with one of the coding positions of the zone 22 and arranged opposite the relevant position and a ninth optical detector 33 which is intended for reading a zone 25 outside the zone 23; zone 25 must not carry any coding track. This latter detector 33 is intended to produce a reference signal indicating absence of a coding track, i.e. logic "0", and also to permit verification of the presence of a round of ammunition.

Figure 2:
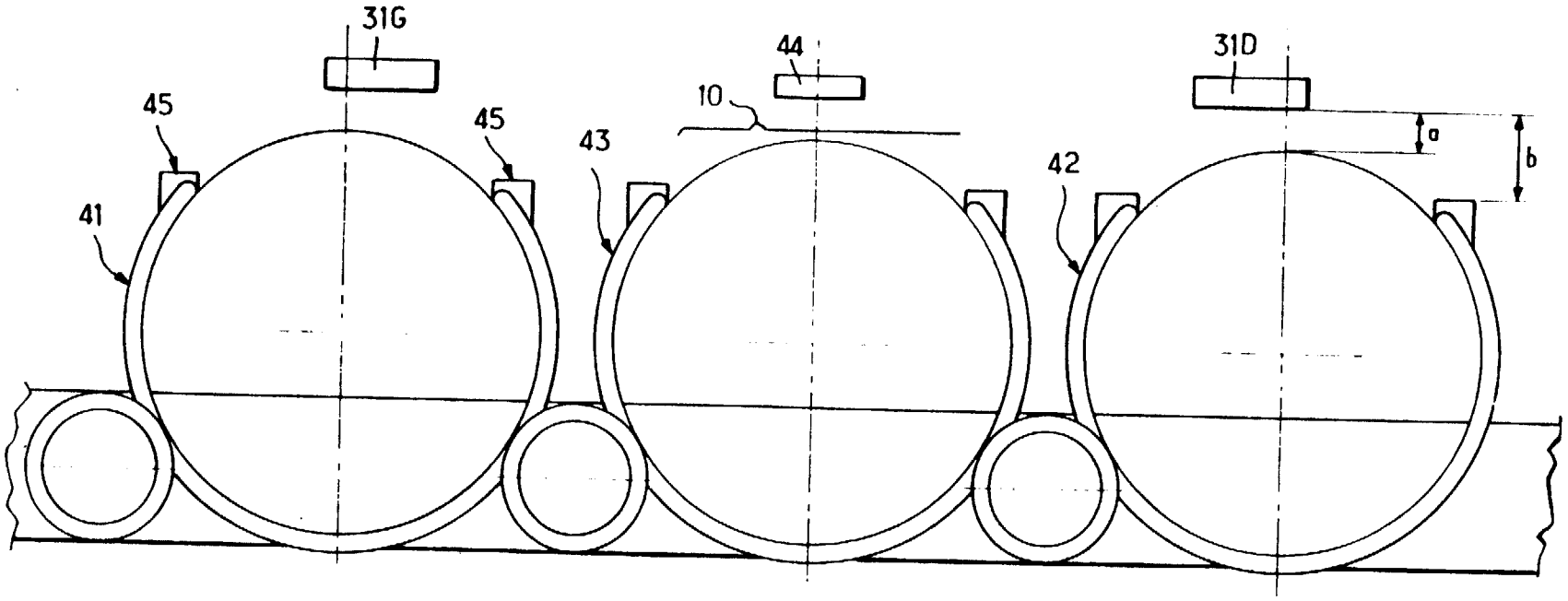
FIG. 2 is a partial view of the rotating magazine showing the chamber present at the loading position and the two adjacent chambers; and, FIG. 3 represents a code reader and a view of part of an ammunition cartridge.

In the invention, two detectors are arranged on the path of the chambers of the rotating magazine; these two detectors are arranged at the level of chambers 41 and 42 respectively, which are positioned to left and right of chamber 43 which is at the loading position 4; there is therefore a left-hand code reader 31G and a right-hand code reader 31D (see FIGS. 2 and 3).

FIG. 2 also shows a fixed detector 44 arranged at the level of chamber 43 which is in the loading position. This detector 44 supplies a signal indicating presence or absence of a round of ammunition in chamber 43 in the loading position.

To test the bar code readers 31G and 31D, on at least one of the chambers two test labels 45 are provided, each comprising eight coding positions which can have a contrasting track arranged perpendicular to the centre line of the chamber so as to provide a test code to be read by the optical detectors 31.

It is advantageous to provide a test label 45 on each of the chambers so that there is always a test label near a code reader; the test procedure then only requires a movement of the conveyor of less than one step, a step being the distance between two adjacent chambers. In this way, testing of one of the code readers can be very quickly carried out.

It is advantageous for the labels 45 to be on the edge of the cut-away part 10 of the chamber so as to be as near as possible to the code readers. In the example shown, the minimum distance a between the cartridge 21 and the reader 31 is approximately 18 mm and the minimum distance b between the label 45 and the reader 31 is about 35 mm. On this basis, the reading conditions for the code on the cartridge and for the label are virtually the same.

In this invention, this device essentially comprises a processing and computing unit 51 consisting of a microprocessor and memories; this unit 51 is contained in the box 9 (see FIG. 1) and it is connected to the code readers 31G and 31D and to the detector 44 for the selected ammunition.

We shall now describe the loading procedure which allows the selected round of ammunition to be transferred in the minimum time to the loading position, in particular in cases where some of the elements of the system are indicated as malfunctioning, i.e. not usable because of a failure.

The processing and computing unit 51 in particular comprises a RAM in which the contents of the magazine are written, i.e., for each chamber, a specific reference for that chamber, data indicating the position of this chamber on the path of the rotating magazine, data indicating absence or presence of a round of ammunition in the chamber and, if a round is present, data on the type of ammunition present, for example the binary code supplied by the readers 31G and 31D. The reference specific to the chamber can for example be a number from 1 to 22 and the data on the position of the chamber on the path of the magazine is supplied by a sensor which supplies data indicating the position of the conveyor, from which the position of the chamber concerned can be deduced.

The normal automatic loading procedure is as follows: the computer 51 reads and then writes in its RAM the identification data on the contents of the rotating magazine during loading of the magazine and then it calculates the number of steps (from 0 to 11 for a magazine with 22 chambers) and the direction of rotation necessary to transfer the nearest round of ammunition of the selected type to the loading position. The only verification then is carried out by the sensor for detecting the presence of ammunition at the loading position 44; if the latter confirms the presence of a round of ammunition, the loading cycle is completed by transfer of this round into the gun. On the other hand, if this sensor 44 does not indicate the presence of a round of ammunition, the chamber is displaced by one step to the right or one step to the left so that it is in front of one of the identification readers 31G, 31D; in this case the data supplied by this reader is processed as data on the presence of a round of ammunition which invalidates that of the ammunition presence sensor 44 which is considered as malfunctioning; the loading instruction is then started again and executed. If the reader used does not supply data indicating presence of an ammunition round, the chamber is moved so that it is in front of the other reader, which, if it identifies the ammunition round (i.e. its presence) enables execution of the loading instruction and memorizes the malfunction of the first code reader and the presence detector 44.

If none of the three sensors, i.e. the presence detector and the two code readers, supplies data on the presence of an ammunition round, the loading sequence is suspended and the reconfiguration procedure is then executed. This consists in checking the contents of each chamber by carrying out a complete rotation of the rotating magazine at constant speed; during this movement, the code readers read on the fly, i.e. when the ammunition is passing, the codes of the ammunition rounds present in the chambers; the data supplies by the presence detector 44 is also stored and its consistency with the data from the two code readers is analyzed.

When the full rotation has been completed, a reading is made of the test codes 45 by each of the two code readers.

If the result of the test is positive, the data contained in the RAM is modified accordingly and, with regard to the contents of the magazine, a majority vote procedure is used between the data from this RAM and those supplied by each of the two readers; the loading operation is then resumed, taking into account the contents of the magazine and, where applicable, the degraded state of one or two sensors.

On the other hand, if the result is negative, the reader concerned is indicated as malfunctioning and the memory configuration is then forced to assume the values read by the second reader.

If the test procedure results in indication of malfunction of both identification code readers, the reconfiguration procedure is impossible. The system is then in complete shut-down.

In addition, the reconfiguration procedure allows automatic suppression of data on malfunction of a reader if the latter correctly identifies the test codes 45, since this malfunction indication may result from degrading of the code of an ammunition round in its support chamber.

The assumptions for executing this analysis are:

that data from a sensor indicated as malfunctioning are not used;

that two sensors cannot fail simultaneously;

the content of the RAM is only updated to the values given by the sensors by a majority vote procedure between the RAM and the two code readers; the ammunition presence detector is only used in the case of an indicated failure of one of the identification code readers;

a round of ammunition, the code of which has been inserted manually, i.e. by the operator during a phase of loading of the rotating magazine, can be identified only by the data supplied by the RAM in view of the fact that a non-coded round or one on which the code has been damaged will produce an inconsistent reading not truly representing this round of ammunition;

in the case of disagreement between the code reading made by one of the readers not indicated as malfunctioning and the contents of the RAM, the reader is considered to be 100% reliable (since it is derived from a consistency analysis);

one code reader may be indicated as malfunctioning, either by inconsistent identification during execution of a loading instruction, or by incorrect reading of the test labels during reconfiguration;

if a code reader reads a consistent code, it is implicitly assumed that a round of ammunition is present;

if a code reader supplies a code which is inconsistent in reconfiguration, the round of ammunition is considered to be present but not recognized.

Analysis of all the presence data and code-reading data and of the contents of the RAM is carried out chamber by chamber. This means that the reconfiguration operation may produce a partly usable result, in particular when only the presence of the ammunition round has been detected.

It can be seen that the invention allows the operation of selection of a round of ammunition for loading in a reliable manner and as quickly as possible, once the operator of the tank has selected the required type of ammunition.

We claim:

1. Device for identifying and checking ammunition for an automatic-loading device of a firearm capable of firing ammunition, said device comprising:

a rotating magazine formed in an endless loop having adjacent chambers, each said chamber capable of accommodating one ammunition round, said chambers capable of moving stepwise about said loop so that each of said chambers can be brought into a loading position, one movement step corresponding to a distance between two neighboring chambers of said adjacent chambers, at least one fixed code reader disposed on a path of said rotating magazine, said fixed code reader including optical detectors aligned in parallel with a longitudinal axis of said ammunition round, a cylindrical coding zone disposed on an outer surface of a cartridge of each said ammunition round, said coding zone including at least one circular coding track contrasting with a surface background of said coding zone, each said coding track being associated with one optical detector of said optical detectors and being disposed opposite said one detector, each said coding track having an identification code different from other said coating tracks for identifying said ammunition round, wherein at least one said chamber of said rotating magazine has at least one test label, said test label having additional coding tracks disposed perpendicularly to said longitudinal axis, said test label disposed opposite said one detector after advancement of said rotating magazine of less than one said movement step.

2. Device as claimed in claim 1, wherein said fixed code reader includes an additional optical detector for detecting said surface background of said coding zone, said additional detector being non-associated with a coding track.

3. Device as claimed in claim 2, wherein two said code readers are disposed on either side of said loading position, and wherein means for processing data supplied by said code readers is provided.

4. Device as claimed in claim 3, further comprising a presence detector for detecting presence of said ammunition round in said chamber at said loading position.

5. Device as claimed in claim 3, wherein said data processing means includes a processor having a RAM, said RAM storing data relating to a location of said ammunition round.

6. Device as claimed in claim 3, further comprising additional test labels, one test label disposed on each said chamber.

7. Method for automatic loading of ammunition for a firearm capable of firing different types of ammunition, said method including the steps of:

(a) providing an automatic loading device for identifying and checking ammunition, said device including:

a rotating magazine formed in an endless loop having adjacent chambers, each said chamber capable of accommodating one ammunition round, said chambers capable of moving stepwise about said loop so that each of said chambers can be brought into a loading position, one movement step corresponding to a distance between two neighboring chambers of said adjacent chambers.

two fixed code readers disposed on either side of said loading position, each said fixed code readers including first optical detectors aligned in parallel with a longitudinal axis of said ammunition round, said code reader including a second optical detector for detecting a surface background of said coding zone.

a cylindrical coding zone disposed on an outer surface of a cartridge of each said ammunition round, said coding zone including at least one circular coding track contrasting with said surface background of said coding zone, each said coding track being associated with one optical detector of said first optical detectors and being disposed opposite said one detector, each said coding track having an identification code different from other said coding tracks for identifying said ammunition round, and means for processing data supplied by said code readers including a processor having a RAM, said RAM for storing data relating to a location of said ammunition round, each said chamber of said rotating magazine having least one test label, said test label having additional coding tracks disposed perpendicularly to said longitudinal axis, said test label disposed opposite said one detector after advancement of said rotating magazine of less than one said movement step.

(b) reading the contents of said magazine into RAM by said processor when a round of said ammunition is requested.

(c) determining the number of steps and direction of movement to be effected by said rotating magazine.

(d) transferring said requested ammunition chamber nearest one of a non-malfunctioning code readers to said loading position so said ammunition is disposed in front of one of said fixed code readers.

(e) verifying the presence of ammunition with said fixed code reader, and (f) verifying the presence of ammunition at the loading position with an ammunition presence detector.

8. Method as claimed in claim 7, wherein after said verifying steps, the following steps are performed:

transferring said chamber at said loading position verified as having no ammunition to a non-malfunctioning fixed code reader.

determining whether a round of ammunition is present in said chamber.

returning said chamber to said loading position if a round of ammunition is present.

designating said ammunition presence detector as being malfunctioning if a round of ammunition is present in said chamber, and reconfiguring said rotating magazine if no ammunition round is present in said chamber.

9. Method according to claim 7, wherein after the verifying steps, the following steps are performed:

determining whether said ammunition presence detector is malfunctioning.

transferring said chamber in said direction of movement to a position directly in front of one of said fixed code readers.

determining if said chamber contains the ammunition round by said one fixed code reader.

returning said chamber to said loading position if said chamber contains the ammunition round.

checking the contents of said chamber by another said fixed code reader if it is determined that no ammunition round is contained in said chamber.

indicating said one fixed code reader as being malfunctioning if said another fixed code reader recognizes an ammunition round is said chamber.

returning said chamber to said loading position, and reconfiguring said rotating magazine if said another fixed code reader does not recognize an ammunition round.

10. Method a claimed in claim 9, wherein said step of reconfiguring said rotating magazine includes completely rotating said magazine at a constant speed, reading said identification code of said various rounds of ammunition, testing each said fixed code reader by (a) displacing said magazine in one direction and performing a code reading, (b) displacing said magazine in an opposite direction and performing a code reading, (c) analyzing said fixed code reader by utilizing said code readings, to determine if said fixed code reader is malfunctioning, said automatic loading device being completely shut down when both said code readers are indicated as malfunctioning.

11. Method according to claim 10, wherein said code readings are used only for updating an initial content of said RAM by a majority vote procedure between said RAM and said fixed code readers.

12. Method as claimed in claim 10, wherein said code readings are analyzed to confirm a correct operation of said fixed code readers which invalidates data indicating a malfunctioning during operation of said device.

13. Method according to claim 7, wherein said step of verifying the presence of ammunition with said fixed code reader further includes moving said rotating magazine through half a step so as to read said test label when said fixed code reader being indicated as malfunctioning when said test label is read incorrectly.

* * * * *